US006824445B2

(12) United States Patent
Oneyear et al.

(10) Patent No.: US 6,824,445 B2
(45) Date of Patent: Nov. 30, 2004

(54) HYBRID BRASSIERE

(75) Inventors: John Oneyear, Advance, NC (US); Heinz Altmann, Winston-Salem, NC (US); Sandra Ann Waitz, Dingmans Ferry, PA (US); Donald Burleson, Henderson, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/108,763

(22) Filed: Mar. 28, 2002

(65) Prior Publication Data

US 2003/0186618 A1 Oct. 2, 2003

(51) Int. Cl.[7] ..... A41C 3/00

(52) U.S. Cl. ..... 450/70; 450/39; 450/54

(58) Field of Search ..... 450/1, 39, 41, 450/46, 47, 49, 51, 52, 53, 54–56, 57, 70, 92, 65, 66; 66/171, 175, 176, 169 R, 170, 190, 192, 195, 196, 202

(56) References Cited

U.S. PATENT DOCUMENTS

| | | | | |
|---|---|---|---|---|
| 2,529,774 A | | 11/1950 | Landau | 2/73 |
| D168,360 S | | 12/1952 | Levy | D20/4 |
| 2,829,650 A | | 4/1958 | Guide | 128/470 |
| 2,940,454 A | | 6/1960 | Faron | 128/491 |
| 3,064,329 A | | 11/1962 | Westberg et al. | 28/74 |
| 3,187,754 A | | 6/1965 | King | 128/464 |
| 3,537,279 A | | 11/1970 | Epley | 66/176 |
| 3,726,286 A | | 4/1973 | Wolfson | 128/473 |
| 3,772,899 A | * | 11/1973 | Novi | 66/176 |
| 3,981,310 A | | 9/1976 | Donaghy | 128/464 |
| 4,203,449 A | | 5/1980 | Winzelberg | 128/473 |
| D256,288 S | | 8/1980 | Stern et al. | D2/24 |
| 4,411,269 A | | 10/1983 | Weintraub | 128/482 |
| D295,110 S | | 4/1988 | Stern et al. | D2/24 |
| 4,767,377 A | | 8/1988 | Falla | 450/65 |
| 4,995,847 A | | 2/1991 | Hwang | 450/71 |
| D319,330 S | | 8/1991 | Akazaki et al. | D2/24 |
| 5,154,659 A | | 10/1992 | Gluckin | 450/39 |
| 5,215,494 A | | 6/1993 | Flanagan | 450/61 |
| 5,427,562 A | | 6/1995 | Hwang | 450/58 |
| 5,855,124 A | | 1/1999 | Donaghy et al. | 66/195 |
| 5,916,829 A | | 6/1999 | Girard et al. | 442/244 |
| 5,957,748 A | | 9/1999 | Ichiha | 450/58 |
| 6,125,664 A | | 10/2000 | Browder, Jr. | 66/176 |
| 6,149,496 A | | 11/2000 | Fildan | 450/58 |
| 6,155,906 A | | 12/2000 | May | 450/88 |
| 6,179,687 B1 | | 1/2001 | Lee et al. | 450/88 |
| 6,186,861 B1 | | 2/2001 | Flaherty | 450/1 |
| 6,190,232 B1 | | 2/2001 | Boser | 450/47 |
| 6,287,168 B1 | | 9/2001 | Rabinowicz | 450/75 |
| 6,334,805 B1 | | 1/2002 | Sawamoto | 450/40 |
| 6,550,286 B2 | * | 4/2003 | Querquant | 66/176 |
| 2001/0012747 A1 | | 8/2001 | Flaherty | |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

A hybrid brassiere is provided. The brassiere has a brassiere body having a pair of side wings/back panels made of circular knit fabric and an integrally knitted band. The brassiere also has a pair of breast cups made from one or more fabrics, namely woven, non-woven, warp knitted, and weft knitted fabrics, and an attachment for connecting the pair of breast cups to the brassiere body.

31 Claims, 3 Drawing Sheets

HYBRID BRASSIERE

BACKGROUND OF THE INVENTION

1. Field of the Invention

The present invention relates to brassieres and methods of making same. More particularly, the present invention relates to brassieres having both circularly knit areas and non-circularly knit areas.

2. Description of the Prior Art

Modern brassieres are designed to accommodate both a need for comfort during wear, as well as a need for support. Therefore, a brassiere must provide both flexibility and freedom of movement, as well as breast support. However, these properties must also be balanced against production costs in order to produce a garment that is competitive in the market.

Brassieres are typically fashioned in a cut-and-sew manner, as exemplified for instance in U.S. Pat. No. 4,372,322 issued to Stern et al. A brassiere made in this manner may consist of more than a dozen separate fabric pieces sewn together. One advantage of the cut-and-sew method is that different areas of the brassiere can be given different properties, since the various fabric pieces can be of different knits, different yarns, etc. It may be advantageous, for example, to make some portions of the brassiere resiliently stretchable to hug the wearer's body, while other portions are relatively unstretchable for providing greater support.

However, the cut-and-sew method is disadvantageous in that it entails a great number of cutting and sewing operations, which can be costly and time consuming to manufacture. Accordingly, methods of fashioning brassieres from circularly knit fabrics have been developed in an effort to improve the speed and efficiency of production. For example, U.S. Pat. No. 4,531,525 to Richards describes the use of a circular knitting machine to produce a seamless garment blank. To assemble a brassiere, the seamless garment blank is cut, folded, and sewn. U.S. Pat. No. 5,592,836 to Osborne describes a brassiere made from a circular-knit garment blank having a welt at one end with a fabric portion integrally knit thereto. The welt forms a torso-encircling portion of the brassiere. To assemble the brassiere, neck and armhole areas are cut in the fabric segment to define front and rear strap portions, which are sewn to complete the formation of the brassiere. However, circular knit garments do not provide the variety of support properties that is provided by a cut-and-sew garment.

Therefore, a need exists for a hybrid brassiere formed from one or more fabric components. The fabric components are, preferably, circularly knit bra side wing/back panels, preferably having an integrally knitted turned welt comfort band and one or more components that are weft knit, warp knit, woven, or non-woven fabric components. A hybrid brassiere provides a garment having the advantages of the cut-and-sew method of production, as well as the advantages of the circular knit method of production. That is, different areas of a brassiere may be given different properties, while maintaining speed and efficiency of production.

SUMMARY OF THE INVENTION

It is an object of the present invention to provide a hybrid brassiere having seamless circularly knit components with an integrally knit band and other fabric components, such as warp knitted, weft knitted, woven, or non-woven components.

It is another object of the present invention to provide such a brassiere having a pair of side wings/back panels that are circularly knit and a pair of breast cups that are weft knit, warp knit, woven, or non-woven.

It is yet another object of the present invention to provide such a brassiere having a pair of side wings/back panels that are circularly knit, a body encircling portion that is knitted in during the circular knitting process to provide a seamless, comfort band, and breast cups that are weft knit, warp knit, woven, or non-woven.

It is a further object of the present invention to provide such a brassiere having a pair of circularly knit side wings/back panels, a circularly knit band being a turned welt preferably forming a body encircling portion, and a pair of breast cups formed of one or more layers of fabric that may be a woven, warp knitted, weft knitted or non-woven component.

It is a still further object of the present invention to provide such a brassiere having a pair of circularly knit side wing/back panels, a circularly knit turned welt forming a body encircling portion, and a pair of breast cups formed of two layers of fabric having a supporting separate layer of fabric between, such as a non-woven in which the turned welt forms a seamless, comfort band.

It is a yet further object of the present invention to provide a method of making a brassiere having circularly knit components or areas and non-circularly knit components or areas using a minimal number of manufacturing steps.

These and other objects and advantages of the present invention are achieved by a hybrid bra or brassiere having a pair of breast cups, preferably a center gore or portion disposed between the breast cups, and a pair of side wings/back panels to connect each breast cup to the back of the brassiere. The hybrid brassiere has one or more additional components, that are of a weft knit, warp knit, woven, or non-woven fabric construction. The brassiere may also include a pair of adjustable shoulder straps. Each strap is connected to a breast cup and a side wing/back panel. The brassiere may also have a pair of arcuate underwire portions, with one arcuate underwire portion adjacent or connected to each breast cup to provide additional breast support. The underwire may be disposed in an arcuate fabric tube, thereby providing increased comfort to the wearer. Alternately, a heat shrinkage yarn may be used to form areas of support that can act as underwire.

BRIEF DESCRIPTION OF THE DRAWINGS

The foregoing and still other objects and advantages of the present invention will be more apparent from the following detailed explanation of the preferred embodiments of the invention in connection with the accompanying drawings.

DETAILED DESCRIPTION OF THE INVENTION

Figure 1:
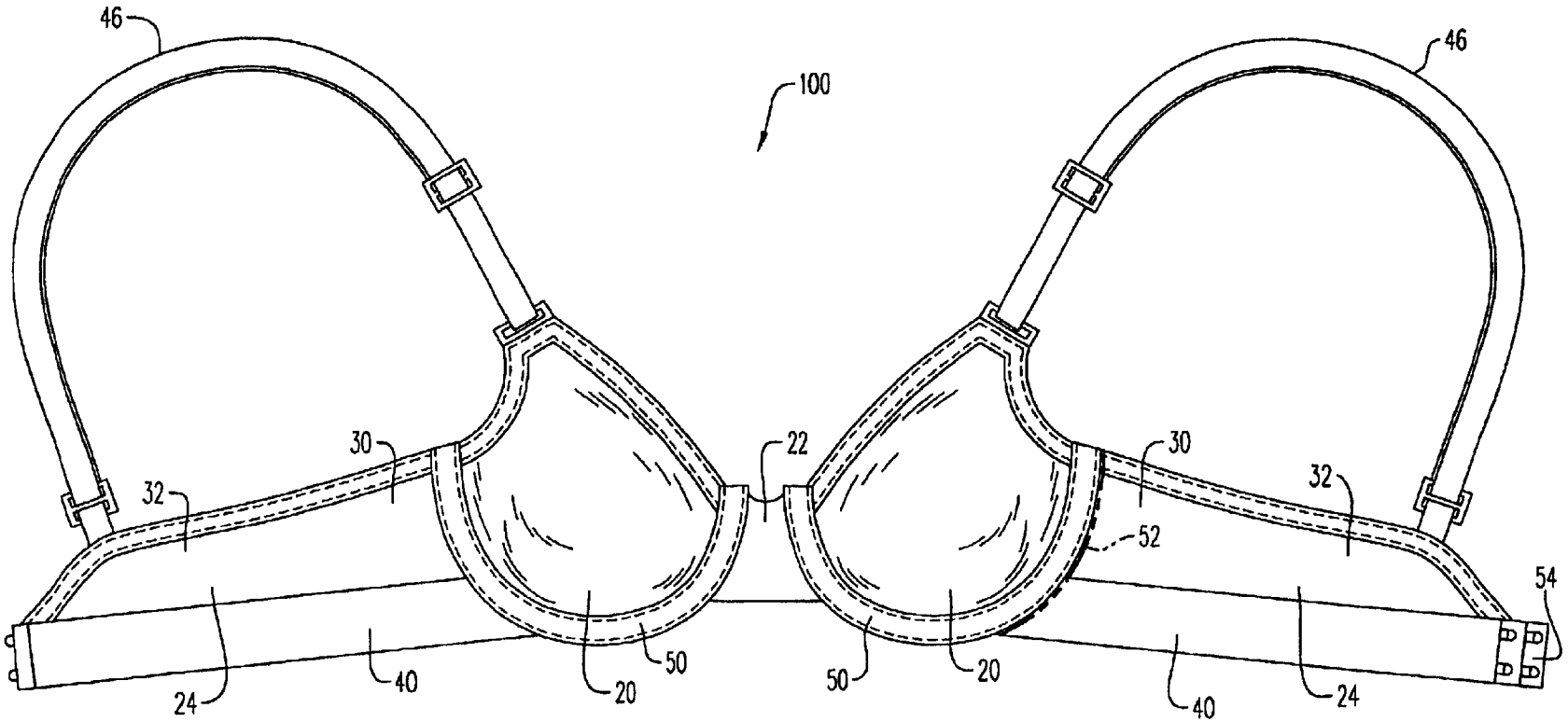
FIG. 1 is a plan view of the back of a brassiere of a preferred embodiment according to the present invention.

Referring to the drawings and, in particular, FIG. 1, there is illustrated a bra or brassiere according to the present invention generally represented by reference numeral 100. Brassiere 100 has a pair of breast cups generally designated by reference numeral 20, preferably a center gore or panel 22 positioned between the breast cups, and a pair of side wings/back panels or portions 24. Each side wing/back panel 24 may have a separate or an integral wing 30 and back portion 32. Each side panel 24 is adjacent to a different breast cup 20 at the wing portion 30 can be connected to the other side panel at back portion 32. Alternately, side panels 24 may be formed of a single, unitary piece.

Each side panel 24 preferably has an integral anchoring chest band 40 disposed on the bottom margin of the brassiere. Most preferably, chest band 40 is a knitted turned welt. The band 40 provides a seamless comfort band. Side panels 24 are removably joined together at the back of the wearer by a closure 54. Closure 54 is preferably formed of conventional adjustable fasteners, such as, for example, hook-and-eye, snap and VELCRO closures, preferably located at the center back of the garment. Closure 54 is preferably adjustable to accommodate the size of the wearer.

Figure 3:
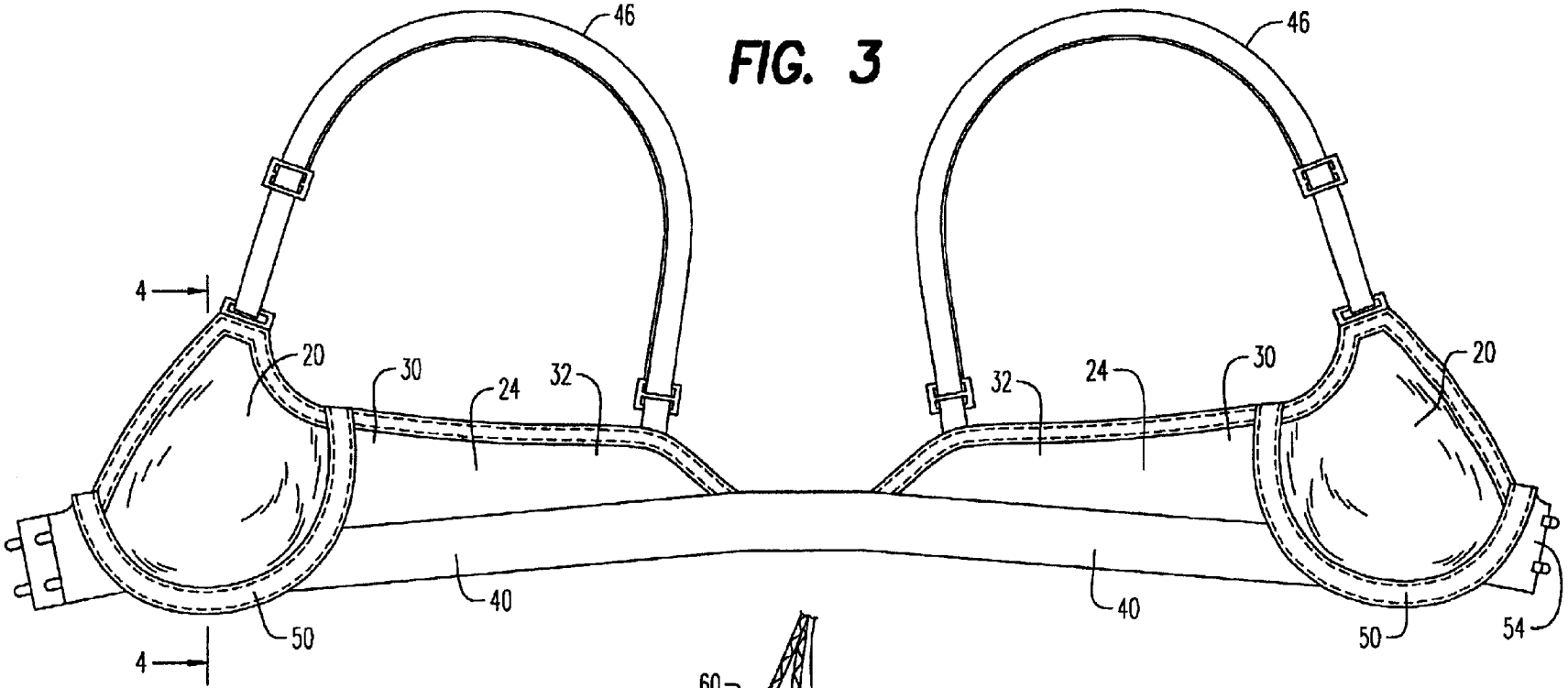
FIG. 3 is a plan view of an alternative embodiment of a brassiere of the present invention having a front closure.

As shown in FIG. 3, closure 54 can be located at the front of the brassiere in the area between breast cups 20, instead of at the back of the brassiere. In the front closure embodiment, the side wings/back panels are an integrally knit unitary piece, rather than two separate pieces, as in the back closure embodiment.

Referring again to FIG. 1, brassiere 100 preferably has a pair of shoulder straps 46 each connected to a different one of a pair of breast cups 20 and one of a pair of side panels 24. The shoulder straps 46 preferably are adjustable. It is to be understood that while the shoulder strap assembly of brassiere 100 as described in FIG. 1 is conventional in nature, alternate constructions may be employed. For example, shoulder straps 46 may cross one another at the back of the wearer, or may, alternately, meet in a common yoke at the back of the wearer. It should also be noted that the present invention may be practiced on a strapless brassiere.

Figure 2:
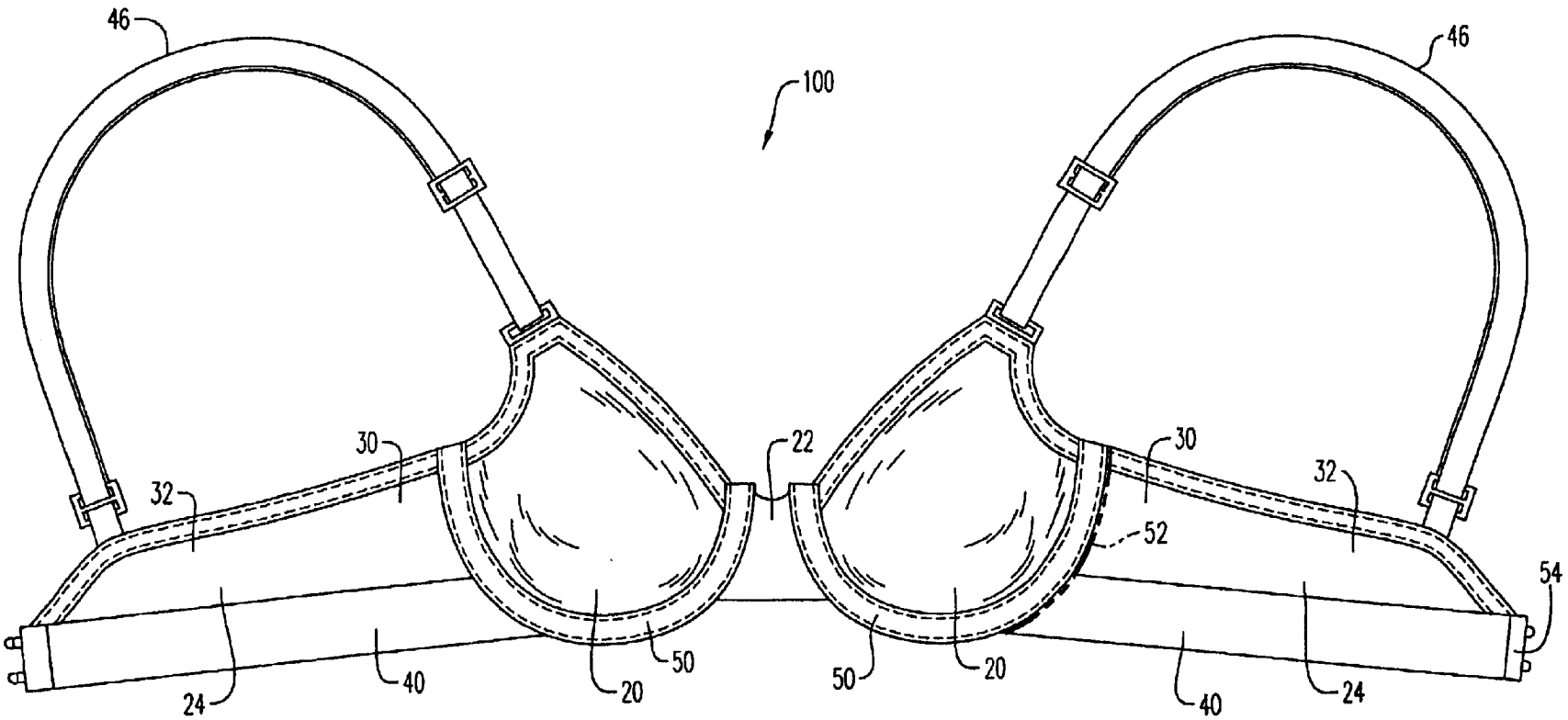
FIG. 2 is a plan view of the front or opposite that of FIG. 1, of the brassiere of FIG. 1.

Referring to FIGS. 1 and 2, brassiere 100 may have an underwire 50. Alternately, brassiere 100 may have a heat shrinkage yarn that can be formed to be a support that can act as underwire. Preferably, the heat shrinkage yarn is formed by splicing in, during knitting, a specific area selected in order to provide the support.

Brassiere 100 is a hybrid brassiere preferably formed of one or more circularly knit fabric components and one or more weft knit, warp knit, woven, or non-woven fabric components. It should be noted that brassiere 100 may, alternately, be formed of one or more circularly knit fabric components that are not integrally formed, but rather are attached by sewing or other fastening means described below.

In the preferred embodiment of the present invention, the brassiere side wings/back panels are made of a seamless circular knit. The breast cups 20 are made of a weft knit, warp knit, woven, or non-woven and secured to the brassiere body by conventional ways of attachment discussed below. In this embodiment, a brassiere blank is produced having a knit construction formed using one or any combination of conventional knit stitches. Such stitches include, but are not limited to, plain, tuck, miss, knit or float stitches.

Combinations of yarns for use in the body of the side wings/back panels may include a synthetic continuous multifilament flat or textured polymer such as nylon, preferably in the range of 10 to 150 denier, spun yarns such as cotton, preferably in the range of 30/1's to 100/1's cotton count range, and elastomeric yarns, preferably in the range of 10 to 100 denier and in the turned welt portion 100 to 240 denier. It should be noted that, while not preferred, multifilament flat or textured polymer nylon could be polyester or polypropylene. The brassiere blank is then laid flat, thereby forming two layers. Alternately, the brassiere blank can be cut along a longitudinal axis and laid flat. A template for side wings/back panels 24 of a selected brassiere size is placed on the brassiere blank to cut the side wings/back panels. A sewing machine that simultaneously cuts away and finishes the periphery following a knit in sew line, thereby forming a finished side panel component that may be used to shape the final side wings/back panels 24. Such circular knit fabric components are formed on a circular knitting machine preferably having a computerized electronic needle and yarn feed selection system such as circular knit machine manufactured by Santoni® or Sangiacomo® of Brescia, Italy. In this embodiment, breast cups 20 are formed of circular weft knit fabric components. Alternate fabric components may be formed of woven, warp knitted, or non-woven fabrics.

Figure 4:
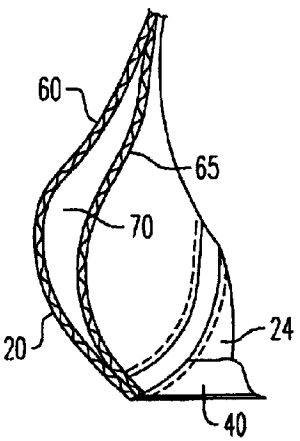
FIG. 4 is a side view of an embodiment of a brassiere of the present invention having a double layer of fabric in the breast cup, which may or may not contain an additional non-woven intermediate layer.

The fabric components used to form breast cups 20 are preferably thermally moldable to form the breast cup shape. Breast cups 20 may, alternately, be formed of multiple layers of fabric. In an embodiment shown in FIG. 4, two layers of fabric are used to form the breast cups 20. Breast cup 20 has an outer face 60. Outer face 60 may be a weft knit, woven, or warp knitted fabric component. Inner cup liner 65 may be a woven, warp knitted, or weft knitted fabric component. Outer face 60 and inner cup liner 65 are molded to form the cup shape. Breast cups 20 are attached to side wings/back panels 24 along an arcuate medial line 52. Attachment may be any manner known in the art for assembling cut-and-sew garments. Examples of such methods for attachment include sewing, heat lamination, thereby using a thermoplastic adhesive or other adhesive type materials, ultra sonic or sonic welding, or any combination of sewing, heat lamination and welding.

Side wings/back panels 24 preferably have an encircling chest band 40. Encircling chest band 40 is preferably formed as an integrally knitted turned welt during the circular knitting process. Encircling chest band 40 provides a seamless, comfort band.

In one embodiment, encircling turned welt chest band 40 is formed by knitting in a heavier denier elastomeric yarn or material in one or more areas during the knitting process to form a welt. Preferably, encircling chest band 40 is formed by adding in spandex elastomeric yarns or nylon covered spandex during the circular knitting process to produce the needed modulus, power, and stretch properties to facilitate a functional fit and comfort level to the wearer while anchoring the brassiere properly on the wearer's body. The elastomeric yarn to be incorporated into the turned welt band 40 can be any yarn having a heavy denier than that used for the remainder of the circularly knit fabric. The higher denier spandex provides additional power to stretch and recovery performance properties to anchoring chest band 40 and makes certain that brassiere 100 stays in place on the wearer's body. Preferably, a range from 100 to 240 denier elastomeric spandex yarn is used to form anchoring chest band 40, such as Lycra® manufactured by duPont. The elastomeric yarn is preferably added in on every fourth course, thereby producing power in anchoring chest band 40. A welt may be formed in any style known in the art for producing a welt including plain, ribbed, decorative or pique.

Referring again to FIG. 4, in any embodiment having multiple layers in breast cups 20, a support or support means may be disposed in the area between the fabric layers 70 of breast cups 20. Support means may be any means known in the art including, but not limited to, fiberfill, padding or a molded foam insert. In one embodiment, a single layer breast cup outer face fabric that is a circular weft knit, woven, or warp knitted fabric may be combined with an inner layer shaped foam cup that is lined with any weft knitted or warp knitted fabric.

Underwire support may be provided by an arcuate underwire 50. The base of breast cups 20 provide direction for the placement of underwire 50, which is preferably separately sewed to the breast cups, thereby forming the bottom edges of the breast cups. The underwire 50 may be disposed in an arcuate fabric tube, thereby providing increased comfort to the wearer. In a multi-layer embodiment of the present invention, underwire 50 may be sandwiched between the layers of brassiere 100 and secured to breast cups 20 by sewing, gluing or other fastening means.

Additional components of brassiere 100 may be attached by conventional ways of attachments discussed above. Such additional components may include, for example, a center gore 22, that can be completely rigid or, alternately, may have a low degree of stretch with higher modulus suitable fabric formed by warp knitting, weft knitting, woven, or non-woven disposed between breast cups 20, for providing added support to the breast cups.

To provide aesthetic and recognizable characteristics to a finished brassiere, the weft knitted blank may have knitted-in patterns on breast cups 20 and on side panels 24. The outer face fabric layer used in the cup area may be a decorative Jacquard design warp knit or weft knit or a Jacquard or Dobby effect woven. Such decorations may include, but are not limited to, floral, abstract or other designs.

The present invention has been described with particular reference to the preferred embodiments. It should be understood that the foregoing descriptions and examples are only illustrative of the present invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A brassiere comprising:

a brassiere body having a pair of side/back panels that include an integrally formed comfort band, said side/back panels being made of one or more layers of a circular knit first fabric; and a pair of breast cups, said pair of breast cups being made of a second fabric separate from said circular knit first fabric;

wherein said pair of breast cups and said brassiere body are connected to form the brassiere.

2. The brassiere of claim 1, wherein each of said pair of breast cups are formed of a second fabric selected from the group consisting of woven, warp knitted, weft knitted, non-woven, and any combinations thereof.

3. The brassiere of claim 1, wherein said second fabric is thermally moldable.

4. The brassiere of claim 1, wherein each of said pair of breast cups has an underwire.

5. The brassiere of claim 1, wherein each of said pair of breast cups has one or more layers.

6. The brassiere of claim 1, wherein each of said pair of cups has a support layer.

7. The brassiere of claim 6, wherein said support layer is formed with an insert selected from the group consisting of a pad, fiberfill, and foam.

8. The brassiere of claim 1, wherein each of said pair of side/back panels are formed of two layers of circular knit fabric.

9. The brassiere of claim 1, wherein said pair of side/back panels each has said comfort band.

10. The brassiere of claim 9, wherein said comfort band is an integrally knitted seamless turned welt.

11. The brassiere of claim 10, wherein said welt connects a first layer of each of said pair of side/back panels and a second layer of each of said pair of side/back panels.

12. The brassiere of claim 10, wherein said welt is formed and supplemented with additional elastomeric yarn in a denier range of 100 to 240 denier during knitting.

13. The brassiere of claim 10, wherein said welt is formed of an elastomeric spandex yarn.

14. The brassiere of claim 13, wherein said elastomeric spandex yarn is in the range of 100 to 240 denier.

15. The brassiere of claim 1, wherein each of said pair of side/back panels is formed on a circular weft knitting machine using yarns selected from the group consisting of synthetic continuous multifilament flat polymer, synthetic continuous multifilament textured polymer, spun yarn, and elastomeric yarn.

16. The brassiere of claim 15, wherein said synthetic continuous multifilament flat or textured polymer is nylon.

17. The brassiere of claim 16, wherein said nylon is in the range of 10 to 150 denier.

18. The brassiere of claim 15, wherein said synthetic continuous multifilament flat or textured polymer is polyester.

19. The brassiere of claim 15, wherein said synthetic continuous multifilament flat or textured polymer is polypropylene.

20. The brassiere of claim 14, wherein said spun yarn is cotton.

21. The brassiere of claim 20, wherein said cotton is in the range of 30/1's to 100/1's count.

22. The brassiere of claim 14, wherein said elastomeric yarn is spandex.

23. The brassiere of claim 22, wherein said spandex is in the range of 10 denier to 100 denier.

24. The brassiere of claim 1, wherein each of said pair of side/back panels is formed using one or more stitches selected from the group consisting of knit, tuck, miss, float, and any combination thereof.

25. The brassiere of claim 1, wherein said pair of breast cups and said brassiere body are connected by a method/material selected from the group consisting of an adhesive, sewn stitches, sonic welding, heat lamination, and any combinations thereof.

26. The brassiere of claim 1, further comprising a front closure for connecting said pair of breast cups together.

27. The brassiere of claim 1, further comprising a back closure for connecting said pair of side panels together.

28. A brassiere comprising:

a brassiere body having a pair of side/back panels, said brassiere body being made of circular knit fabric;

a pair of breast cups, said pair of breast cups being made of one or more fabrics, said one or more fabrics separate from said circular knit fabric and selected from the group consisting of woven, non-woven, warp knit, and weft knit; and a turned welt connecting a first layer of each of said pair of side/back panels and a second layer of each of said pair of side/back panels;

wherein said pair of breast cups and said side/back panels are connected to form the brassiere.

29. A method of making a finished brassiere comprising:

circularly knitting a fabric tubular blank to form a pair of side/back panel components;

thermally molding a pair of breast cup components from a fabric separate from the blank, wherein the fabric is selected from the group consisting of woven, weft, and warp knit to form a finished breast cup; and joining said pair of breast cup components to said pair of side/back panel components to form the finished brassiere.

30. The method of claim 29, further comprising the step of joining two or more fabric layers to form each of said pair of breast cup components.

31. The method of claim 30, wherein said pair of breast cup components are joined to said pair of side/back panel components by using a method/material selected from the group consisting of a thermoplastic adhesive, adhesive type material, sewn stitches, sonic welding, ultrasonic welding, heat lamination, and any combinations thereof.

* * * * *